US007509951B1

(12) United States Patent
Smith

(10) Patent No.: US 7,509,951 B1
(45) Date of Patent: Mar. 31, 2009

(54) INTERNAL COMBUSTION ENGINE COVER WITH ELECTRONIC MODULE

(75) Inventor: Thomas E. Smith, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/926,679

(22) Filed: Oct. 29, 2007

(51) Int. Cl.
*F01M 13/00* (2006.01)

(52) U.S. Cl. ..... 123/573; 123/634; 123/635; 123/647; 123/196 A; 123/196 S

(58) Field of Classification Search ..... 123/196 A, 123/196 S, 634, 635, 647, 573
See application file for complete search history.

(56) References Cited

U.S. PATENT DOCUMENTS

| | | | | |
|---|---|---|---|---|
| 4,401,093 | A | 8/1983 | Gates, Jr. et al. | |
| 5,129,371 | A | 7/1992 | Rosalik, Jr. | |
| 5,450,835 | A | 9/1995 | Wagner | |
| 5,979,422 | A * | 11/1999 | Flierl et al. | 123/647 |
| 6,193,528 | B1 * | 2/2001 | Rea et al. | 439/127 |
| 6,546,921 | B1 * | 4/2003 | Callahan | 123/573 |
| 6,609,508 | B2 * | 8/2003 | Sexton | 123/634 |
| 7,059,311 | B2 | 6/2006 | Prasad | |
| 2001/0052342 | A1 | 12/2001 | Mammarella | |
| 2003/0062301 | A1 | 4/2003 | Merrie et al. | |
| 2006/0236989 | A1 * | 10/2006 | Callahan | 123/574 |

FOREIGN PATENT DOCUMENTS

| | | |
|---|---|---|
| JP | 6-229222 | 8/1994 |

* cited by examiner

*Primary Examiner*—Erick Solis
(74) *Attorney, Agent, or Firm*—Dickinson Wright PLLC; Julia Voutyras

(57) ABSTRACT

An internal combustion engine cover includes a peripheral rail for attaching a cover to an engine component and an enclosure portion formed integrally with a peripheral rail. At least one port formed in the enclosure portion holds an electronic module which is mounted through the port and which may include an oil separator as well as an electronic device.

12 Claims, 4 Drawing Sheets

Prior Art

INTERNAL COMBUSTION ENGINE COVER WITH ELECTRONIC MODULE

CROSS REFERENCE TO RELATED APPLICATIONS

None.

BACKGROUND OF THE INVENTION

1. Field of the Invention

This disclosure relates to a cover for a portion of an internal combustion engine. The cover has one or more ports for attaching an electronic module to the cover.

2. Disclosure Information

It is frequently desirable to fasten various electronic modules to the covers of internal combustion engines. Such modules include, without limitation, spark coils, modules related to electronic throttle control, cruise control, and other devices. FIG. 7 shows a prior art ignition coil which is intended to be mounted to a cover by means of three fasteners which pass through machined brass inserts, 100, which are molded into place in the ignition coil. The three fasteners holding the coil are threaded into tapped holes formed in a cover. This type of mounting is expensive and time consuming because of the additional parts and machining required, and is not user-friendly for assembly of the engine.

It would be desirable to provide a mounting for electronic modules such as spark coils upon engine covers without the need for either tools or additional machining operations, while providing additional function such as the separation from oil from crankcase gases.

SUMMARY OF THE INVENTION

An internal combustion engine cover includes a peripheral rail for attaching the cover to an engine component, and an enclosure portion formed integrally with the peripheral rail. A port is formed in the enclosure portion and holds an electronic module. Electronic modules mounted to the port preferably utilize a threaded engagement, with the electronic module having a camlock, or threaded, portion engaging with a corresponding threaded or camlock portion formed in the port.

According to another aspect of the present invention, an engine cover may further include an oil separator depending from an electronic module, with the oil separator extending into a blow-by channel defined at least in part by the enclosure portion of the cover.

It is an advantage of a cover system according to the present invention that the need for machining of covers, and the assembly of parts to covers using threaded fasteners or rivets, may be eliminated.

It is another advantage of the system according to the present invention that field servicing of components attached to covers is readily facilitated.

It is yet another advantage of a system according to the present invention that the cost of mounting hardware to a cover is reduced with use of the present invention.

It is yet another advantage of a combination electronic module and oil separator according to the present invention that multiple oil separation devices may be incorporated within an engine, so as to cause a high percentage of the oil entrained within gas flowing through the positive crankcase ventilation system to be removed and returned to the crankcase.

Other advantages, as well as features of the present invention, will become apparent to the reader of this specification.

DETAILED DESCRIPTION OF THE PREFERRED EMBODIMENT

Figure 1:
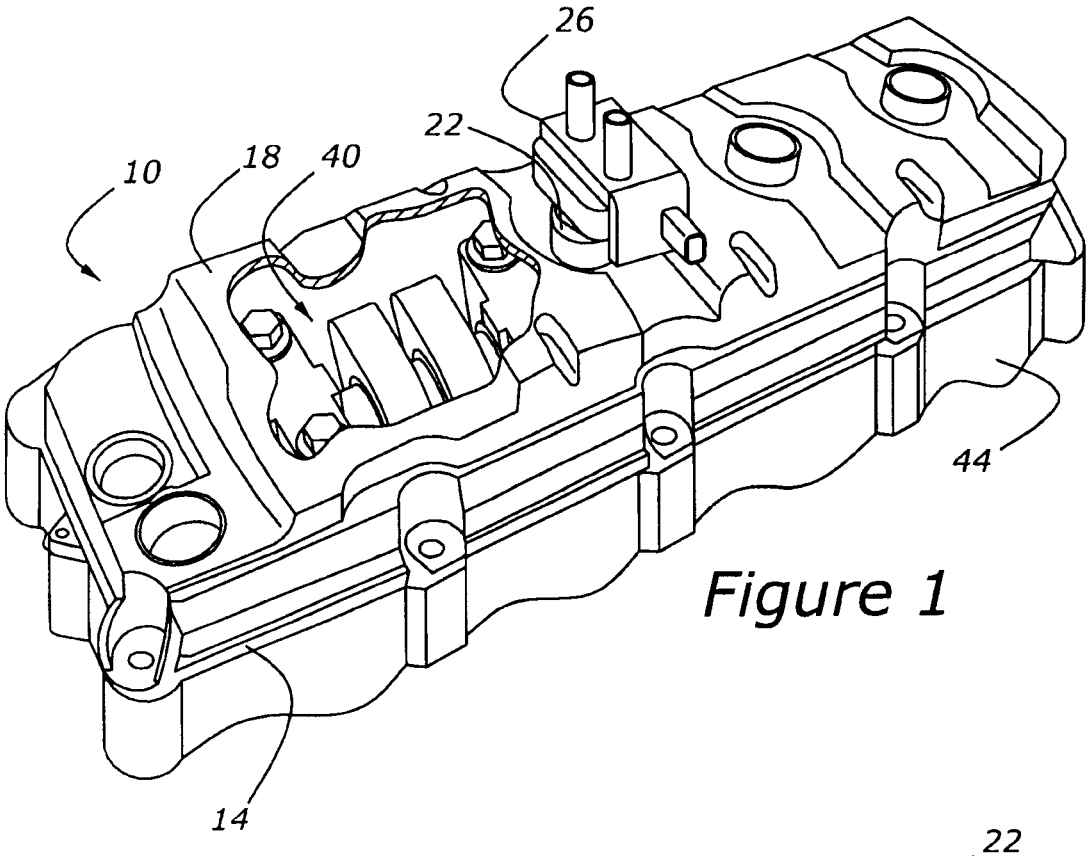
FIG. 1 is a perspective view of an internal combustion engine cover according to the present invention.
Figure 2:
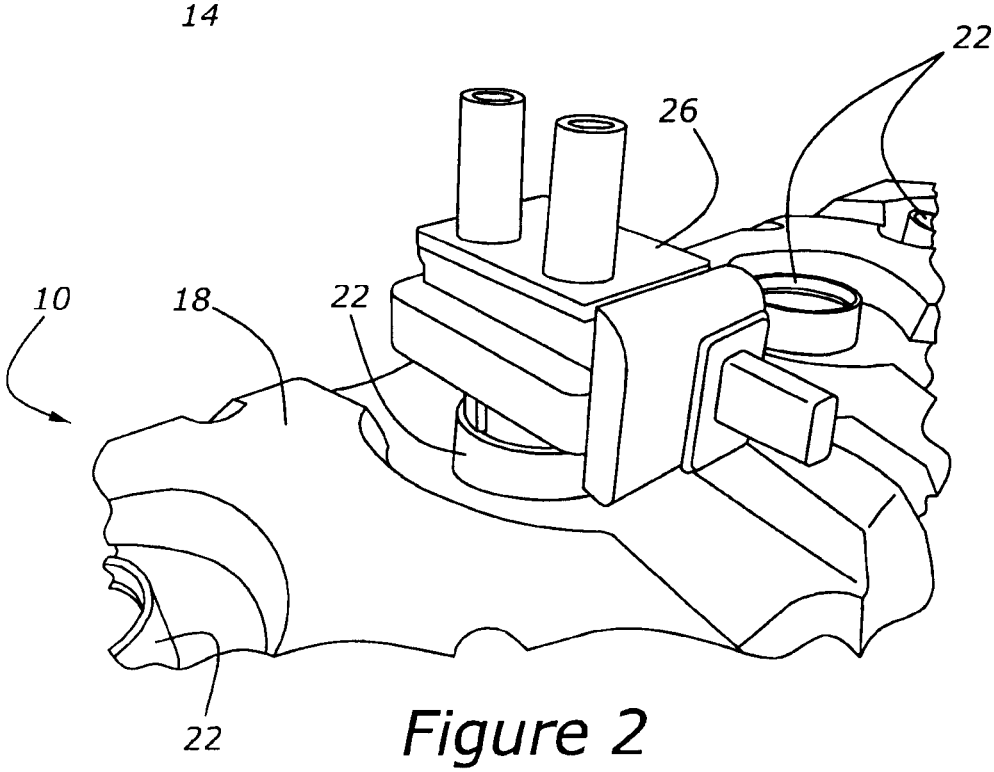
FIG. 2 is similar to FIG. 1 but shows a close-up view of the cover having an electronic module mounted to the cover according to the present invention.

As shown in FIG. 1, cover 10 has a peripheral rail, 14 for attaching cover 10 to an engine component such as the illustrated cylinder head, 44. FIG. 1 shows cover 10 as having an enclosure portion, 18, enclosing a camshaft, 40 which is mounted to cylinder head 44. An ignition coil, 26 is shown as being mounted to one of ports 22 incorporated within cover 10. Three additional mounting locations are also featured on cover 10, but with only one coil 26 being shown in FIG. 1. FIG. 2 is an enlarged view of a portion of FIG. 1, showing with specificity the enclosure portion 18 of cover 10, having a coil 26 mounted thereto. FIG. 2 shows the exterior portion of several ports, 22 which extend through enclosure portion 18 of cover 10.

Figure 3:
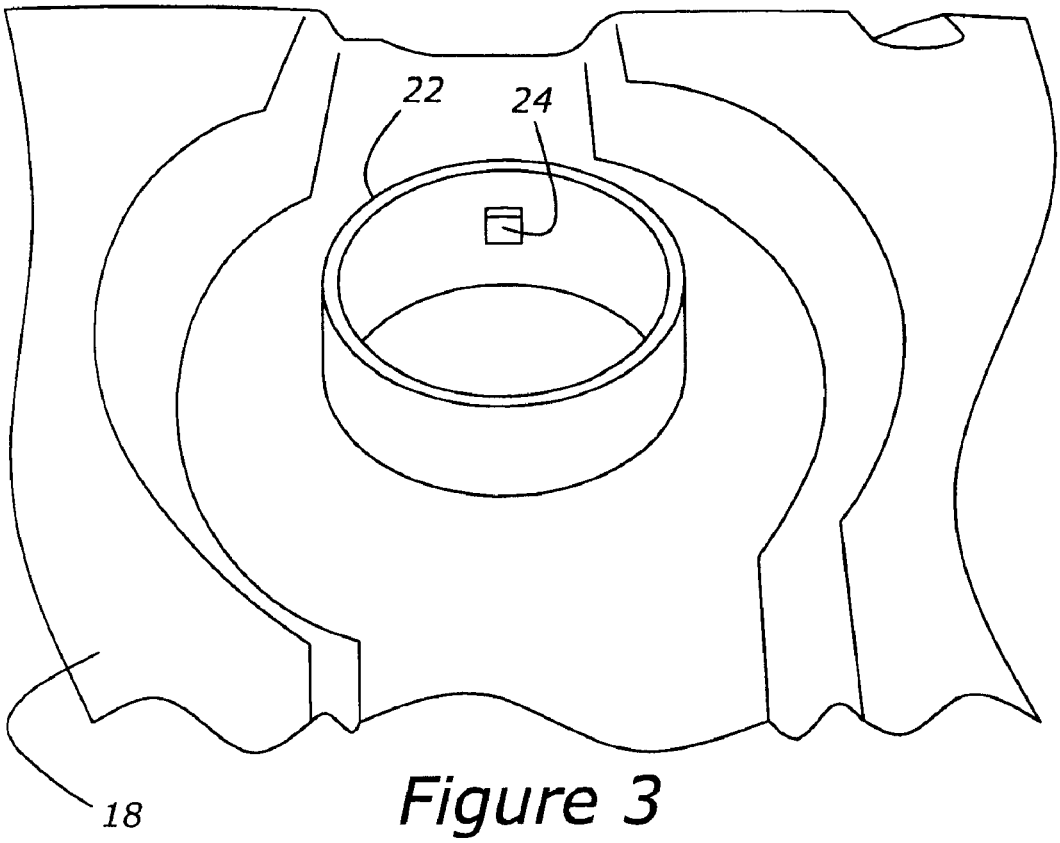
FIG. 3 shows details of a port formed in a cover according to an aspect of the present invention.
Figure 4:
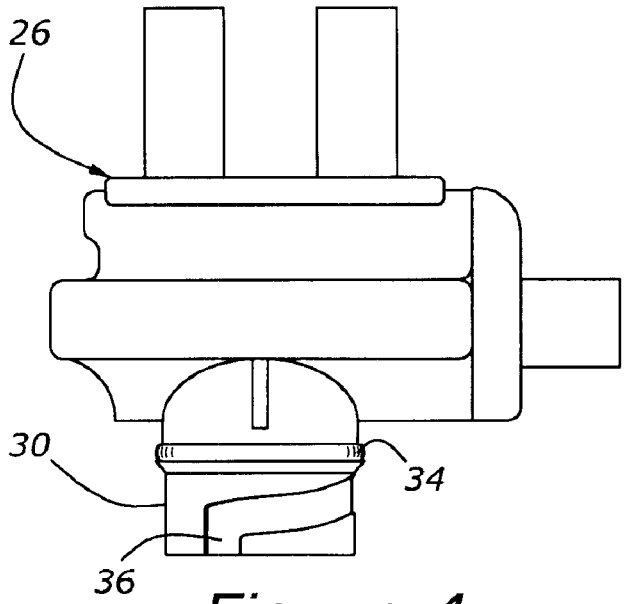
FIG. 4 shows an electronic module, in this case, a spark module or ignition coil according to an aspect of the present invention.

Details of the fastening provisions of the present invention are shown in FIG. 3. Port 22 is shown as having a male threadform configured as a tang, 24, which projects radially into port 22 and which function as a second portion of a camlock. Tang 24 is formed integrally with port 22. Tang 24 meshes with a female portion, 36, which is shown in FIG. 4 as being an integral part of camlock portion 30 of ignition coil 26. When coil 26 is inserted into one of ports 22 and twisted, camlock portions 24 and 36 lock coil 26 into position within the port and cause coil 26 to be sealingly engaged with port 22. Sealing engagement of coil 26 with port 22 is promoted by O-ring 34, shown in FIGS. 3 and 5.

Figure 5:
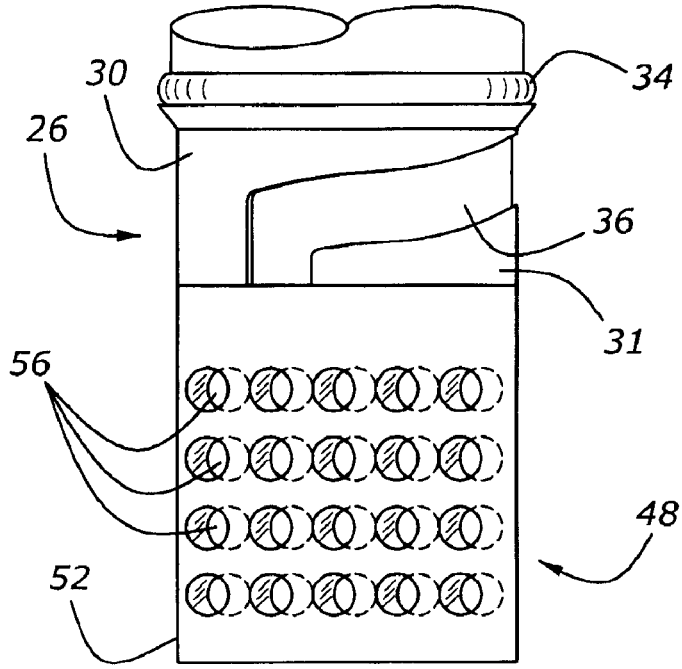
FIG. 5 illustrates further details of an electronic module having an oil separator incorporated therein.

FIG. 5 illustrates an embodiment of the invention further including an oil separator, 48, which depends from camlock portion 30 of electronic module 26. In this embodiment, shell 31 is overmolded upon electronic device 26. Shell 31 is unitary with camlock portion 30 and a pair of stripper plates, 52, which are described below.

Oil separator 48 includes two generally parallel stripper plates, 52, with each of the plates having a number of orifices 56 formed therein. Orifices 56 are offset so that oil-laden air passing through an engine's crankcase ventilation system will be caused to impact on the plates, while jogging through orifices 56, with the result that the oil will be stripped from the air or in this case, blow-by gases, and allowed to drain back down into the engine. The collection in drain-back of the oil from blow-by is facilitated by structures shown in FIG. 6.

Figure 6:
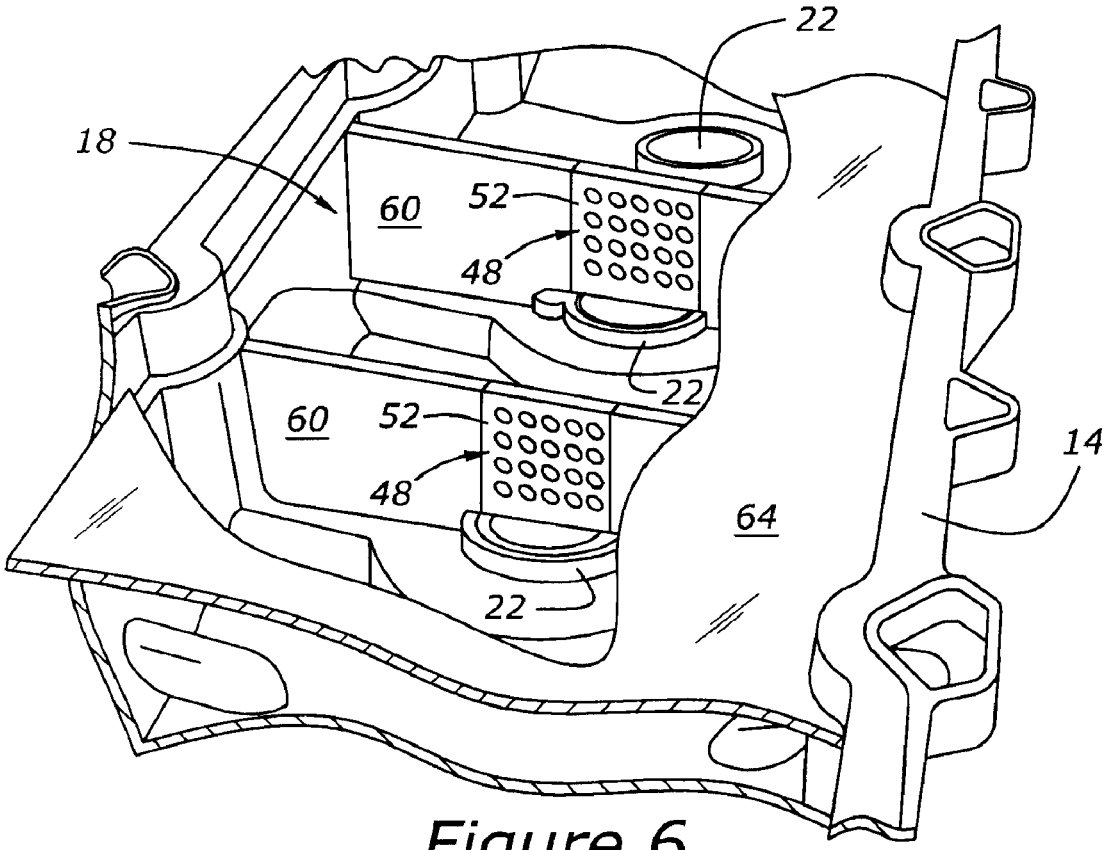
FIG. 6 illustrates a bottom view of a cover according to the present invention showing the placement of an oil separator according to an aspect of the present invention.
Figure 7:
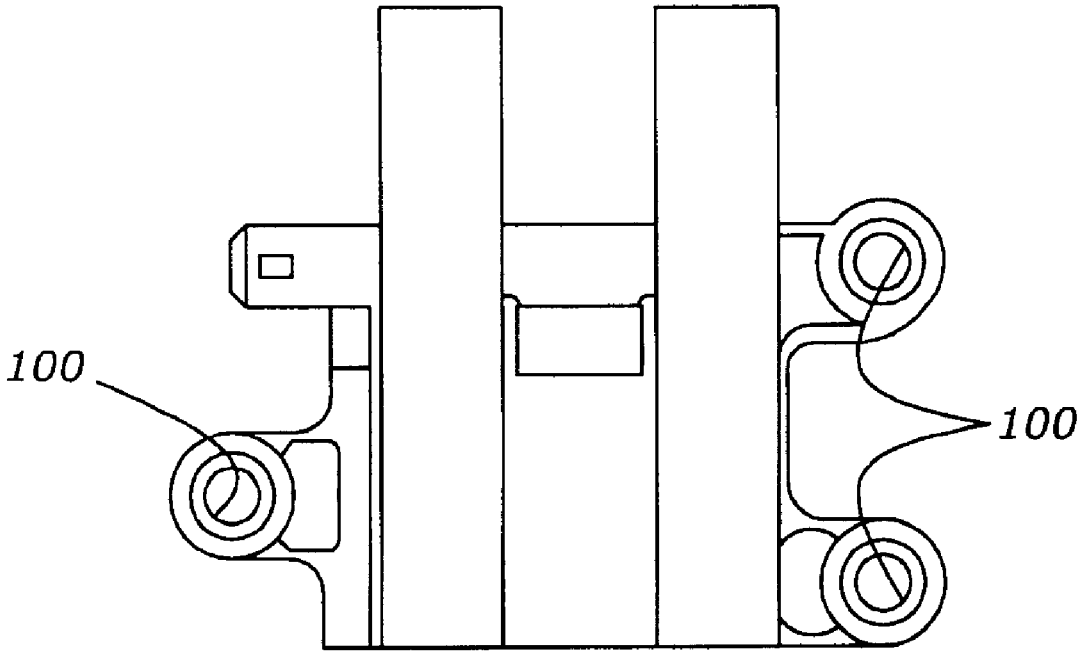
FIG. 7 illustrates a prior art ignition coil.

FIG. 6 shows the bottom inside portion of cover 14 with one of oil separators 48 mounted, and more specifically showing oil separator stripper plates 52. FIG. 6 also shows baffle walls 60 and baffle plate 64, both of which assist in channeling oil-laden blowby gases past one or more oil separators 48.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An internal combustion engine cover, comprising:

a peripheral rail for attaching the cover to an engine component;

an enclosure portion formed integrally with said peripheral rail;

a port, formed in said enclosure portion, for holding an electronic module;

an electronic module mounted to said port; and an oil separator depending from said electronic module, with said oil separator extending into a blowby channel defined at least on part by said enclosure portion of said cover, as well as by a baffle plate mounted to said enclosure portion so as to define a floor of said blowby channel.

2. An engine cover according to claim 1, wherein said electronic module comprises an ignition coil for a spark-ignition engine.

3. An engine cover according to claim 1, wherein said electronic module is threadedly engaged with said port.

4. An engine cover according to claim 1, wherein said electronic module is engaged with said port by a camlock having a first portion integral with said electronic module, and a second portion integral with said enclosure portion of said cover.

5. An engine cover according to claim 1, wherein said enclosure portion encloses at least one camshaft carried within a cylinder head.

6. An engine cover according to claim 1, further comprising an oil separator depending from said electronic module.

7. An engine cover according to claim 1, wherein said oil separator comprises a plurality of staggered orifices formed in a plurality of flow plates.

8. An internal combustion engine cover, comprising:

a peripheral rail for attaching the cover to an engine component;

an enclosure portion formed integrally with said peripheral rail;

a port, formed in said enclosure portion, for holding an electronic module, with said port extending through a wall of said enclosure portion; and an electronic module mounted through said port, with said electronic module comprising:

an electronic device comprising an ignition device;

an oil separator; and a camlock portion extending between and integral with said electronic device and said oil separator, with said camlock portion engaging a wall of said port so as to retain said electronic module within said port, while positioning said oil separator within a space enclosed by said cover.

9. An engine cover according to claim 8, further comprising a shell, overmolded upon said electronic device, and unitary with at least said camlock portion.

10. An engine cover according to claim 9, wherein said shell is unitary with said oil separator.

11. An engine cover according to claim 8, wherein said enclosure portion encloses a portion of a cylinder head.

12. An engine cover according to claim 8, further comprising at least one additional electronic module mounted through an additional port formed in said enclosure portion.

* * * * *